US011114770B2

(12) United States Patent
Chen et al.

(10) Patent No.: US 11,114,770 B2
(45) Date of Patent: Sep. 7, 2021

(54) ANTENNA STRUCTURE AND WIRELESS COMMUNICATION DEVICE USING THE SAME

(71) Applicant: Shenzhen Next Generation Communications Limited, Shenzhen (CN)

(72) Inventors: Kuo-Cheng Chen, New Taipei (TW); Jian-Wei Chang, New Taipei (TW); Zheng Lin, Shenzhen (CN); Jia Chen, Shenzhen (CN); Ke-Jia Lin, Shenzhen (CN); Yun-Han Chen, Shenzhen (CN)

(73) Assignee: Shenzhen Next Generation Communications Limited, Shenzhen (CN)

( * ) Notice: Subject to any disclaimer, the term of this patent is extended or adjusted under 35 U.S.C. 154(b) by 19 days.

(21) Appl. No.: 16/683,728

(22) Filed: Nov. 14, 2019

(65) Prior Publication Data

US 2020/0176891 A1 Jun. 4, 2020

(30) Foreign Application Priority Data

Nov. 29, 2018 (CN) ..... 201811446794.9

(51) Int. Cl.
*H01Q 21/24* (2006.01)
*H01Q 1/22* (2006.01)
*H01Q 1/24* (2006.01)

(52) U.S. Cl.
CPC ..... *H01Q 21/24* (2013.01); *H01Q 1/2283* (2013.01); *H01Q 1/243* (2013.01)

(58) Field of Classification Search
CPC ..... H01Q 21/24; H01Q 1/2283; H01Q 1/243; H01Q 25/001; H01Q 1/38; H01Q 1/50; H01Q 21/0006; H01Q 21/08; H01Q 1/523; H01Q 1/48; H01Q 1/22
See application file for complete search history.

(56) References Cited

U.S. PATENT DOCUMENTS

| | | | | |
|---|---|---|---|---|
| 5,923,296 | A * | 7/1999 | Sanzgiri | H01Q 1/246 343/700 MS |
| 8,514,139 | B2 * | 8/2013 | Adams | H01Q 13/18 343/770 |
| 9,096,029 | B2 | 8/2015 | Sung et al. | |
| 9,413,074 | B2 * | 8/2016 | Enders | H01Q 13/18 |
| 10,057,796 | B2 | 8/2018 | Elsherbini et al. | |
| 2010/0033396 | A1 | 2/2010 | Tanabe et al. | |

FOREIGN PATENT DOCUMENTS

| | | | |
|---|---|---|---|
| CN | 1812697 | A | 8/2006 |
| CN | 101872888 | A | 10/2010 |
| CN | 105633597 | A | 6/2016 |
| CN | 207426169 | U | 5/2018 |
| TW | I378601 | B1 | 12/2012 |

* cited by examiner

*Primary Examiner* — Khai M Nguyen
(74) *Attorney, Agent, or Firm* — ScienBiziP, P.C.

(57) ABSTRACT

An antenna structure suitable for 5G use includes first and second antenna units. Each second antenna unit is positioned between adjacent first antenna units. Each first antenna unit is positioned between adjacent second antenna units. Each first antenna unit and each second antenna unit are restricted to emit a radio beam in a single polarization. The first antenna unit emits radio waves in a first polarization, the second antenna unit emits waves in a second polarization. The first polarization direction and the second polarization direction are perpendicular to each other.

18 Claims, 11 Drawing Sheets

ANTENNA STRUCTURE AND WIRELESS COMMUNICATION DEVICE USING THE SAME

FIELD

The subject matter herein generally relates to antennas.

BACKGROUND

The 5G standard covers a very wide bandwidth of 26.5 GHz-40 GHz. For specific frequency bands, a frequency can be shifted because of small size of antenna for millimeter-scale wavelengths, and a poor processing, which can affect an antenna performance. The millimeter-scale wave antenna suffers large propagation losses, the antenna itself needs compensation from an antenna array combination to increase its own gain. Arranging several antenna arrays in a limited space is problematic in millimeter-scale wavelength antenna design.

Therefore, there is room for improvement within the art.

BRIEF DESCRIPTION OF THE DRAWINGS

Implementations of the present disclosure will now be described, by way of embodiment, with reference to the attached figures.

DETAILED DESCRIPTION

Figure 1:
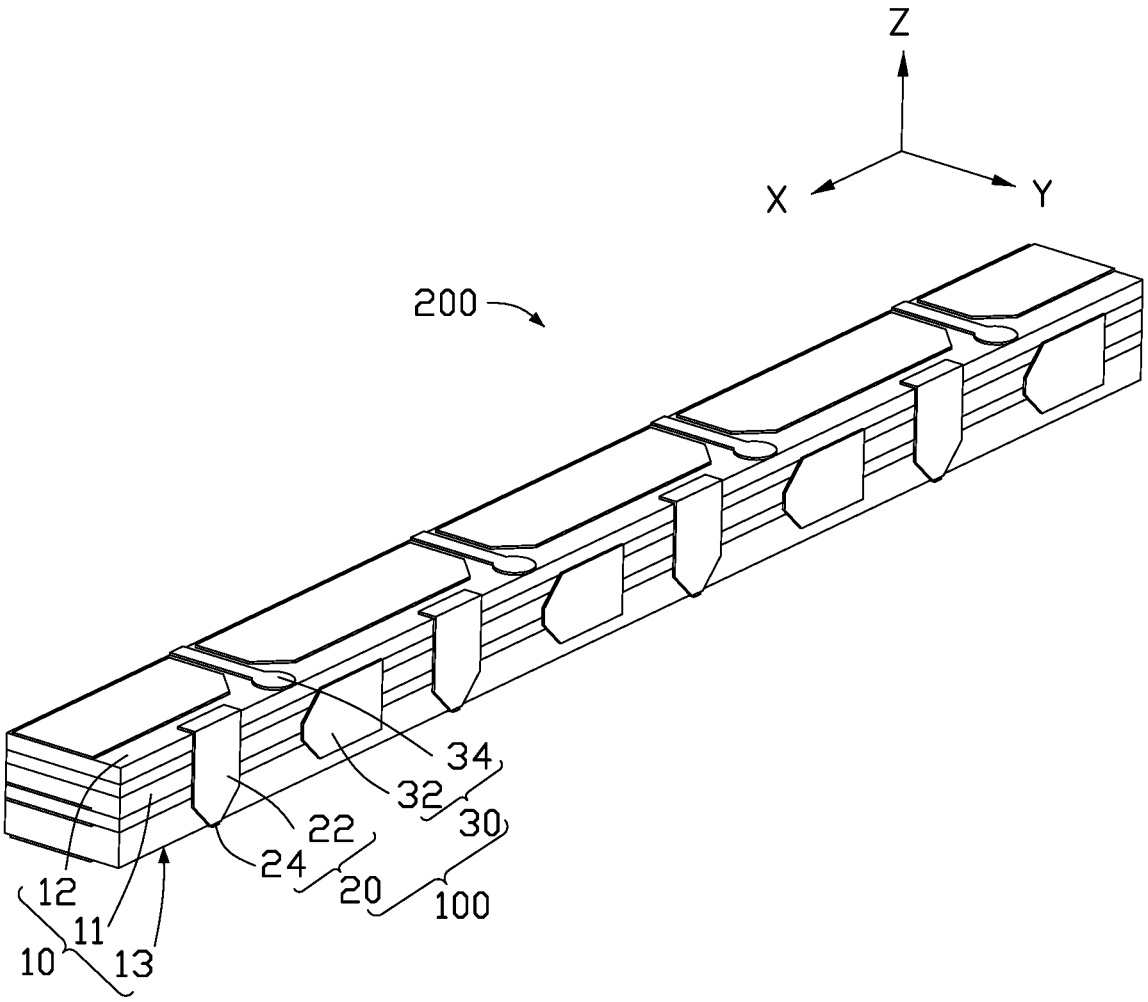
FIG. 1 is an isometric view of an embodiment of an antenna structure used in a wireless communication device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better illustrate details and features of the present disclosure.

Several definitions that apply throughout this disclosure will now be presented.

The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising" when utilized, means "including, but not necessarily limited to"; it specifically indicates open-ended inclusion or membership in the so-described combination, group, series, and the like.

The present disclosure is described in relation to an antenna structure and a wireless communication device using the same.

FIG. 1 illustrates an embodiment of antenna structure 100 used in a wireless communication device 200. The antenna structure 100 is configured for receiving and transmitting wireless signals. The wireless communication device 200 can be, for example, a mobile phone or a personal digital assistant.

Figure 2:
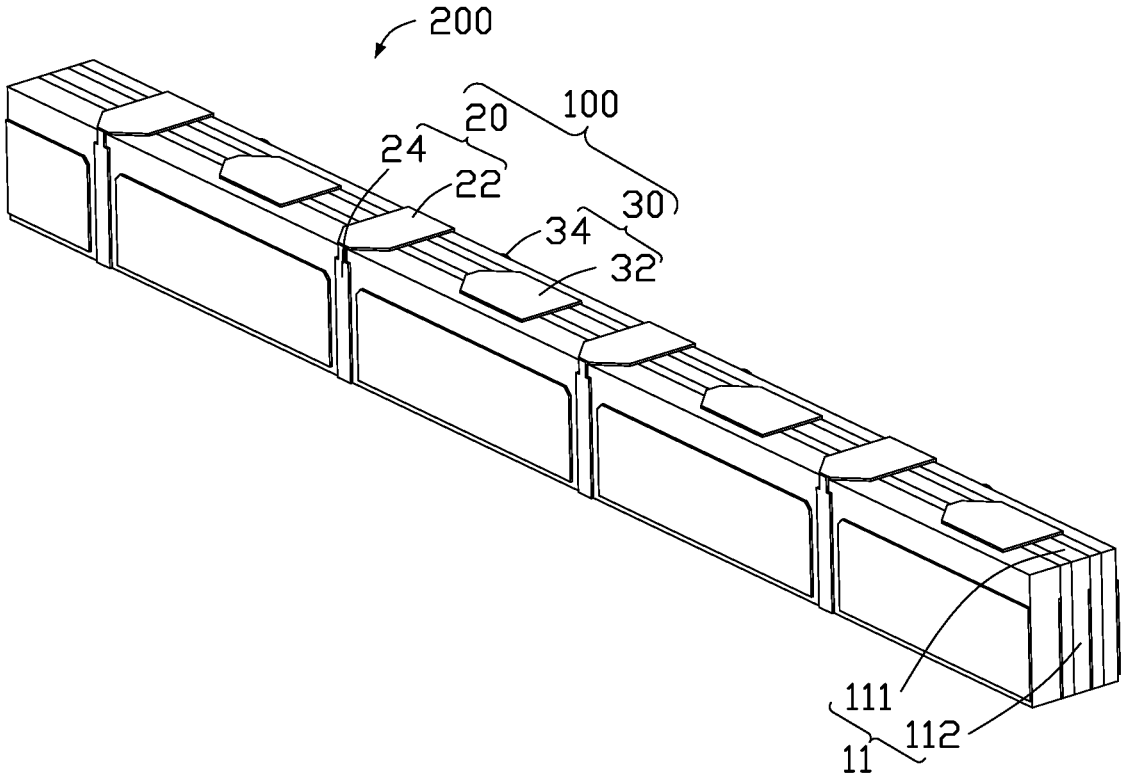
FIG. 2 is similar to FIG. 1, but from another aspect.

Referring to FIG. 2, the wireless communication device 200 includes a dielectric board 10. The dielectric board 10 is a printed circuit board (PCB). The dielectric board 10 can be made of dielectric materials such as epoxy glass fiber (FR4), or the like.

The dielectric board 10 includes a side wall 11, an upper surface 12, and a bottom surface 13 opposite to the upper surface 12.

The side wall 11 connects the upper surface 12 and the bottom surface 13. The side wall 11 includes two opposite first walls 111 and two opposite second walls 112. The first walls 111 and the second walls 112 form a substantially rectangular frame for carrying the antenna structure 100.

The antenna structure 100 includes a plurality of first antenna units 20 and a plurality of second antenna units 30. The plurality of first antenna units 20 and the plurality of second antenna units 30 are in one straight line, but arranged alternately. A second antenna unit 30 is positioned between adjacent the first antenna units 20, and a first antenna units 20 is positioned between adjacent second antenna units 30. Each first antenna unit 20 and each second antenna unit 30 are restricted to emit a radio beam in a single polarization direction.

The first antenna unit 20 emits radio waves in a first polarization direction. The second antenna unit 30 emits radio waves in a second polarization direction. The first polarization direction is perpendicular to the second polarization direction. In this embodiment, the first polarization direction is a Z-axis direction as shown in FIG. 1, and the second polarization direction is an X-axis direction as shown in FIG. 1. Signal transmission of the first antenna unit 20 and the second antenna unit 30 are both in a positive Y-axis direction as shown in FIG. 1.

In this embodiment, a number of the first antenna units 20 and a number of the second antenna units 30 is the same.

Figure 3:
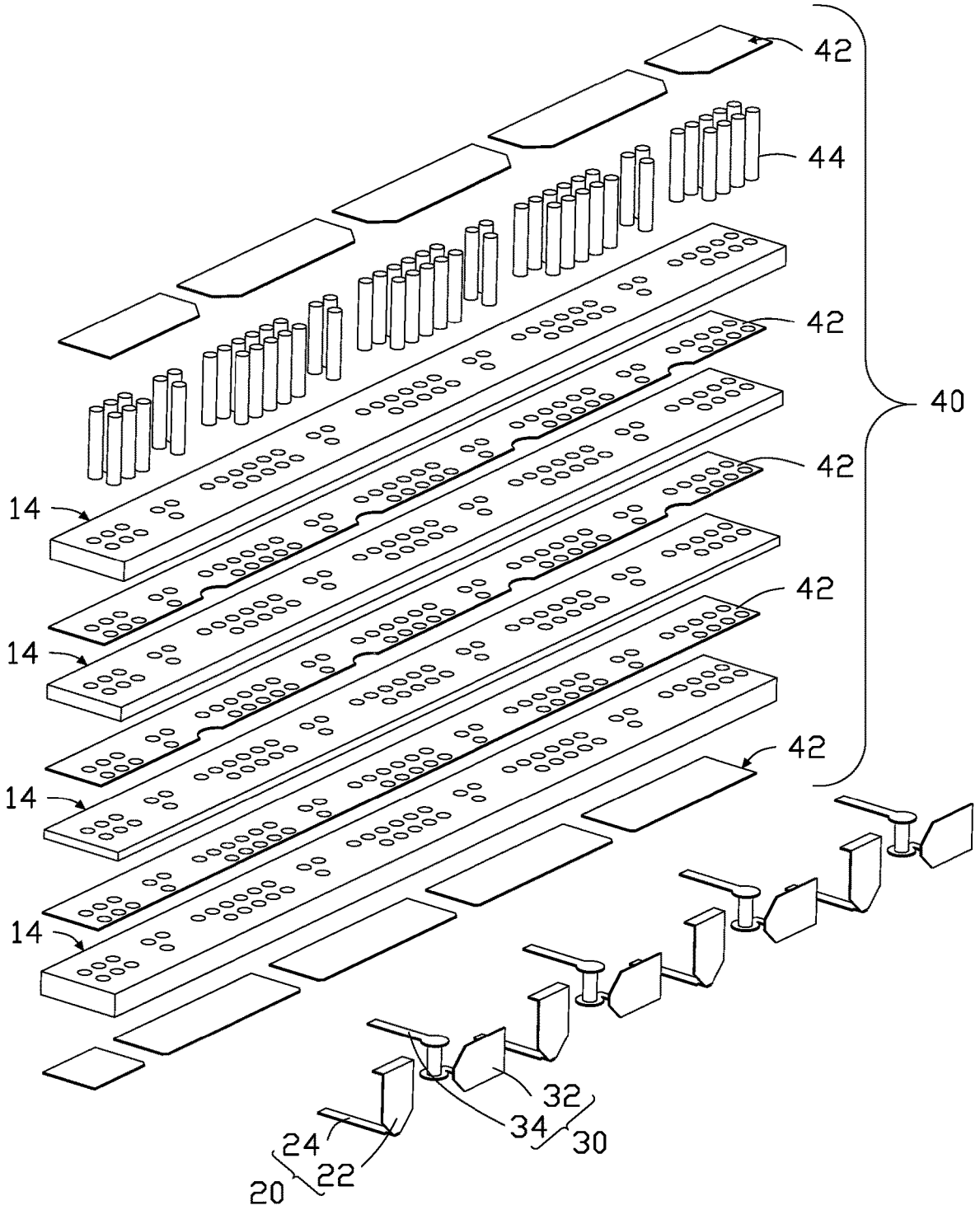
FIG. 3 is an isometric view of the wireless communication device of FIG. 1.

Referring to FIG. 3, each first antenna unit 20 includes a first antenna 22 and a first feeding line 24. Each first antenna 22 is positioned between adjacent second antennas 32. A distance between edges of two second antennas 32 is 0.5-0.7 of a wavelength, the wavelength being the wavelength of electromagnetic waves transmitted or received by the second antenna 32 in the air.

The first feeding line 24 is configured for feeding current to the first antenna 22 thereby activating the first antenna 22 to generate electromagnetic waves in the first polarization direction. The second feeding line 34 is configured for feeding current to the second antenna 32 thereby activating the second antenna 32 to generate electromagnetic waves in the second polarization direction.

Figure 5:
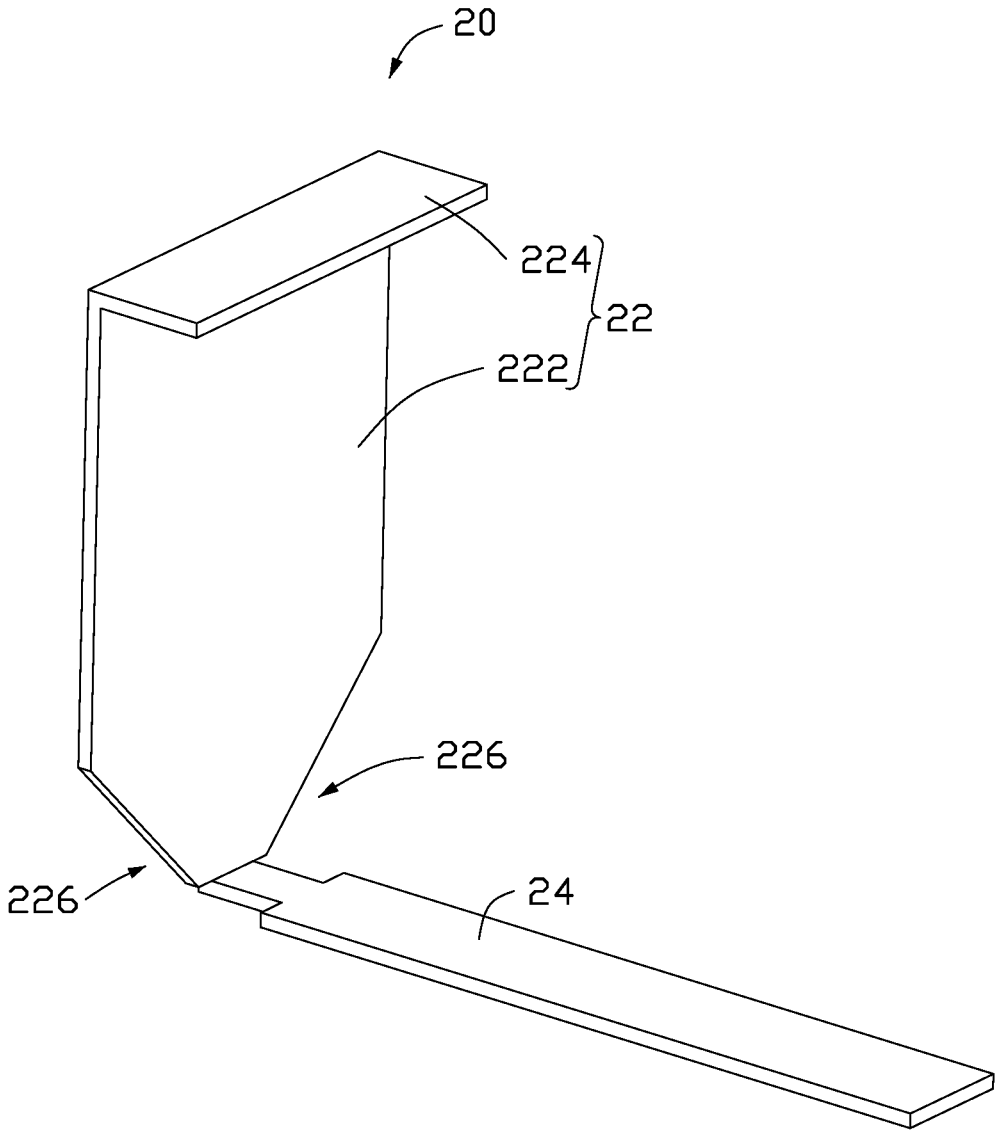
FIG. 5 is an isometric view of a first antenna unit of the antenna structure of FIG. 1.

Also referring to FIG. 5, the first antenna 22 includes a main body 222 and a bending portion 224. The main body 222 is disposed on the first wall 111 of the dielectric board 10. The bending portion 224 is bent relative to the main body 222 and disposed on the upper surface 12 of the dielectric board 10. In this embodiment, the bending portion 224 is substantially a rectangular structure.

The first feeding line 24 is positioned on the bottom surface 13 of the dielectric board 10. The first feeding line 24 is connected to a first end of the main body 222. A second end of the main body 222 is connected to the bending portion 224. The first end of the main body portion 222 defines two notches 226 configured for increasing a bandwidth of the first antenna 22.

Figure 4:
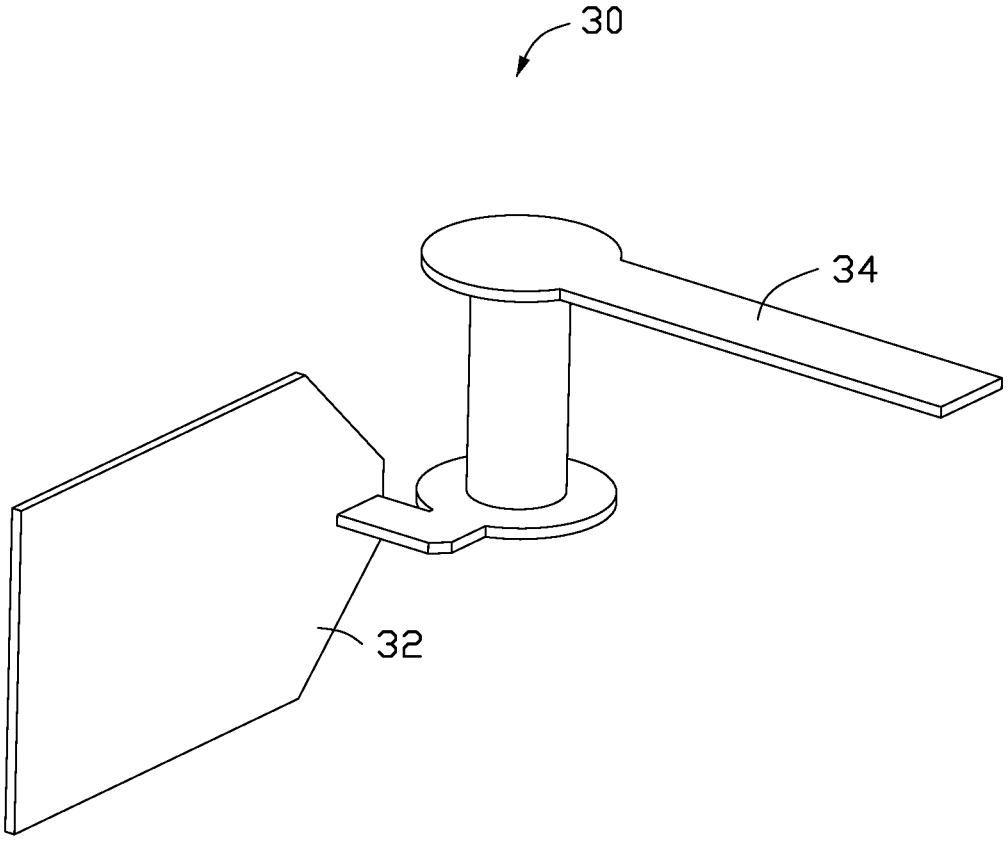
FIG. 4 is an isometric view of a second antenna unit of the antenna structure of FIG. 1.

Also referring to FIG. 4, each second antenna unit 30 includes a second antenna 32 and a second feeding line 34.

The second feeding line 34 is positioned on the upper surface 12 of the dielectric board 10. The second feeding line 34 is connected to a first end of the second antenna 32. The first end of the second antenna 32 defines two cuts or notches (not labeled) for increasing a bandwidth of the second antenna 32.

Referring to FIG. 3 again, in an embodiment, the antenna structure 100 further includes a grounding portion 40. The grounding portion 40 is configured for grounding the first antenna unit 20 and the second antenna unit 30.

The dielectric board 10 includes N dielectric layers 14. The grounding portion 40 includes N+1 grounding layers 42 and at least one via 44, wherein N is a positive integer.

The dielectric layers 14 and the grounding layers 42 are alternately stacked. The via 44 is substantially a cylindrical structure. The via 44 passes through each dielectric layer 14 to connect to each grounding layer 14. Each dielectric layer 14 is parallel and spaced apart. Each grounding layer 42 is parallel and spaced apart.

The first antenna units 20, the second antenna units 30, the grounding layers 42, and the vias 44 are all made of conductive materials, such as metal.

In an embodiment, as shown in FIG. 3, N is equal to 4, the dielectric board 10 includes four dielectric layers 14, and the ground portion 40 includes five grounding layers 42. Each dielectric layer 14 is positioned between adjacent grounding layers 42.

Thus, the dielectric board 10 insulates the grounding portion 40 from the first antenna unit 20 and the second antenna unit 30.

Figure 6:
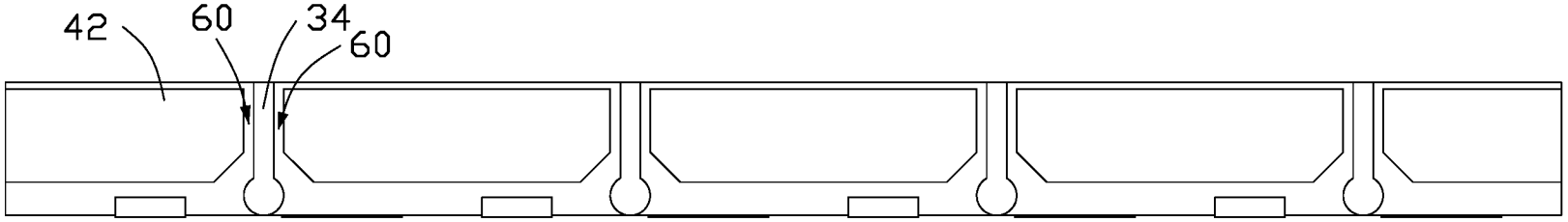
FIG. 6 is a top view of the wireless communication device of FIG. 1.

Referring to FIG. 6, the antenna structure 100 can further include a co-planar waveguide (CPW). In this embodiment, the CPW is substantially a rectangular sheet structure. The CPW includes a plurality of second feeding lines 34, a grounding layer 42 positioned on the upper surface 12 of the dielectric board 10, and a plurality of slots 60. Each slot 60 is at one side of each second feeding line 34. The slot 60 is configured for separating the second feeding line 34 from the grounding layer 42. The second feeding line 34 and the grounding layer 42 are coplanar. The second feeding line 34 and the grounding layer 42 are both made of conductive materials. Thus, the second feeding line 34 and the grounding layer 42 are coplanar, which reduces environmental interference to the second feeding line 34

Figure 7:
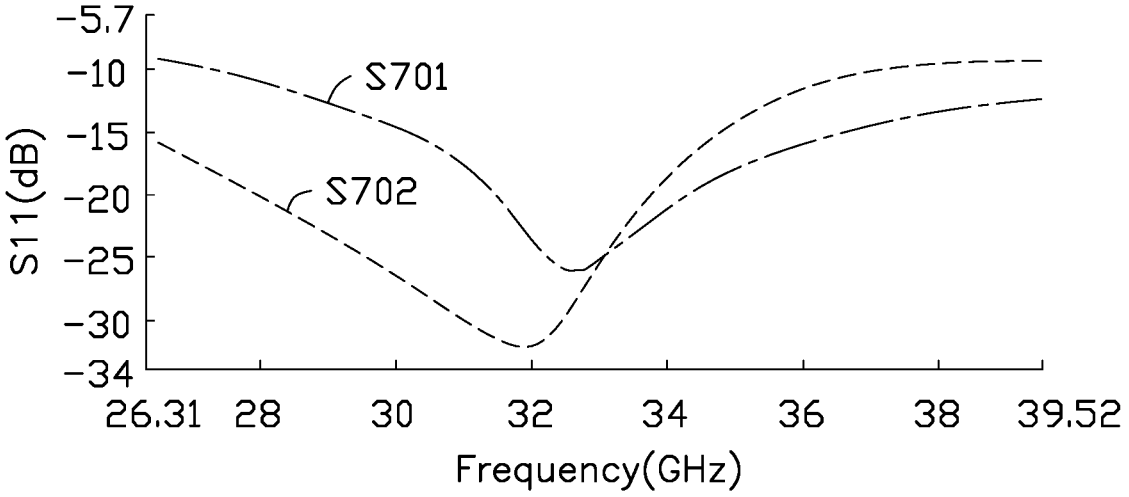
FIG. 7 is a graph of scattering parameters of the antenna structure of FIG. 1.

FIG. 7 is a graph of scattering parameters of the antenna structure 100. Curve S702 represents a scattering parameter of the first antenna unit 20. Curve S701 represents a scattering parameter of the second antenna unit 30. As shown in FIG. 7, the antenna structure 100 has a return loss of less than −10 dB in an ultra-wide band of 26.5 GHz-39 GHz, with impedance matching suitable for ultra-wideband performance.

Figure 8:
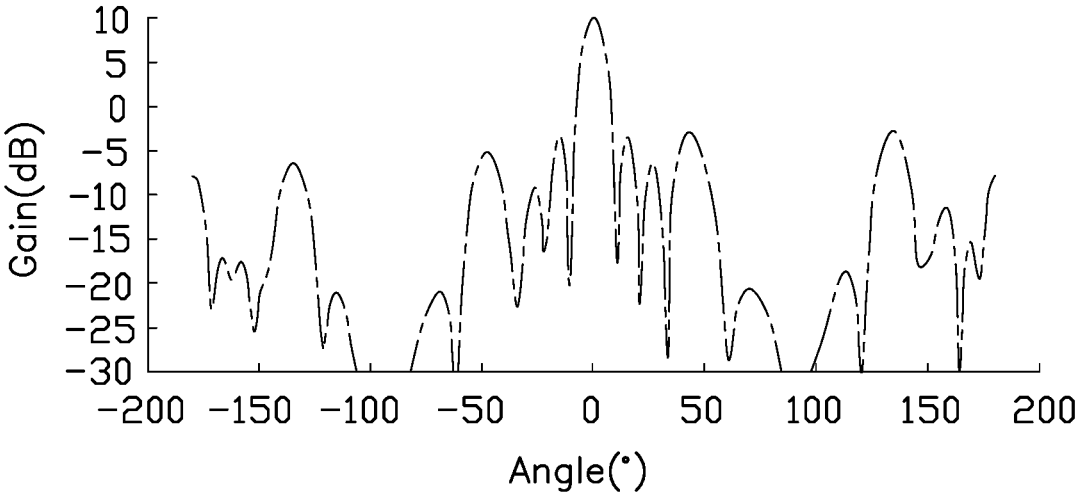
FIG. 8 is a graph of radiating gain of the second antenna unit of the antenna structure of FIG. 1.
Figure 9:
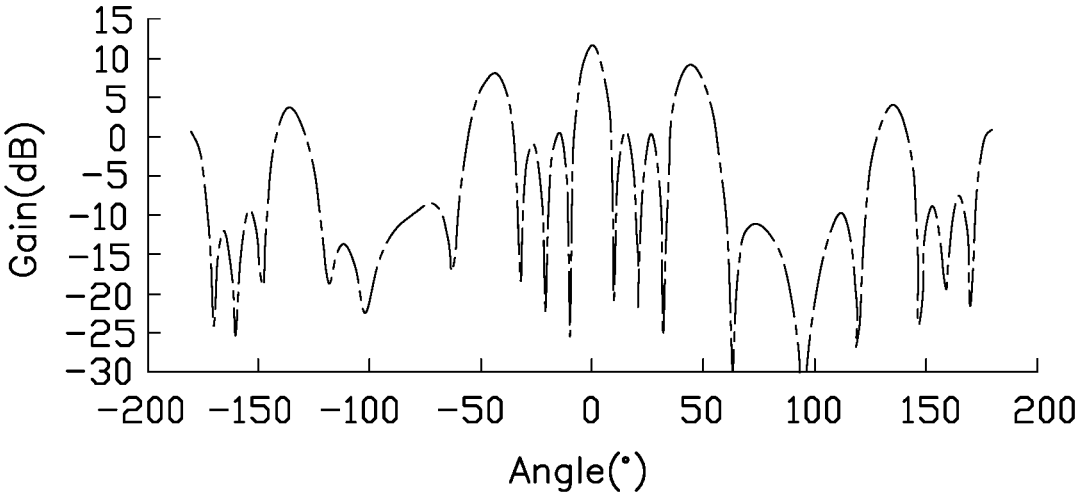
FIG. 9 is a graph of radiating gain of the first antenna unit of the antenna structure of FIG. 1.

FIGS. 8 and 9 show radiating gains of the second antenna unit 30 and of the first antenna unit 20. As shown in FIGS. 8 and 9, the first antenna unit 20 and the second antenna unit 30 both have a high gain of about 10 dB.

Figure 10:
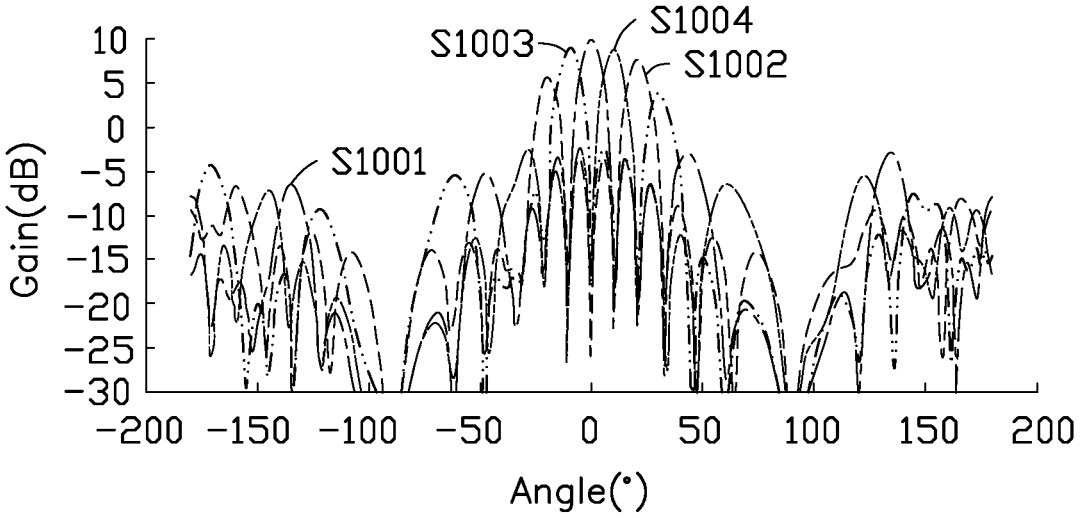
FIG. 10 is a graph of beam scanning of the antenna structure of FIG. 1.

FIG. 10 is a beam scanning graph of the antenna structure 100. The vertical axis in FIG. 10 is an actual gain of the antenna structure 100. The horizontal axis of FIG. 10 is an angle on a circumference centered on the antenna structure 100, wherein 0 degrees is the positive Y-axis direction shown in FIG. 1. Four curves S1001, S1002, S1003, and S1004 correspond to beam angles of 0 degrees, 20 degrees, 10 degrees, and −10 degrees respectively. The beam angle is defined as an angle between a beam emitting direction of the antenna structure 100 and the positive Y-axis direction.

Figure 11:
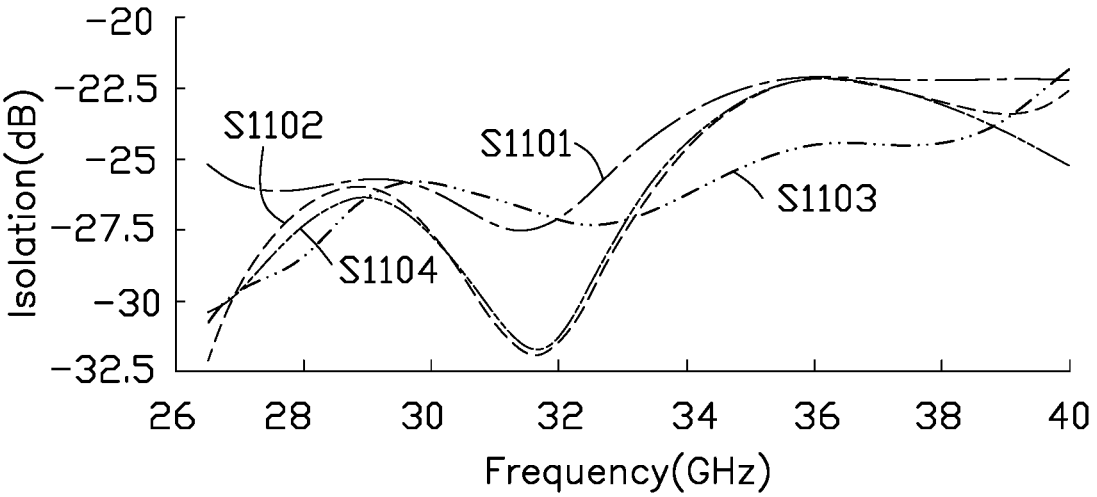
FIG. 11 is graph showing isolation between the first antenna unit and the second antenna unit of FIG. 1.

FIG. 11 shows isolation between the first antenna unit 20 and the second antenna unit 30 of FIG. 1. Curve S1101 represents an isolation between the first one of the first antenna units 20 and the first one of the second antenna units 30, counting from the left in FIG. 1. Curve S1102 represents an isolation between the second one of the first antenna units 20 and the second one of the second antenna units 30, also from the left. Curve S1104 represents an isolation between the third one of the first antenna units 20 and the third one of the second antenna units 30 from the left. Curve S1103 represents an isolation between the fourth one of the first antenna units 20 and the fourth one of the second antenna units 30 from the left. As shown in FIG. 11, each pair of antenna units with perpendicular polarization directions (i.e. the first antenna unit 20 and the second antenna unit 30) achieve isolation of less than −22 dB.

The first antenna units 20 and the second antenna units 30 are arranged in one straight line. Each first antenna unit 20 is positioned between adjacent second antenna units 30. The polarization directions of the first antenna units 20 are perpendicular to the polarization directions of the second antenna units 30. The antenna structure thus achieves ultra-wideband performance, and interference generated by close proximity between adjacent antenna units is reduced.

The embodiments shown and described above are only examples. Many details are often found in the art such as the other features of the antenna structure and the wireless communication device. Therefore, many such details are neither shown nor described. Even though numerous characteristics and advantages of the present disclosure have been set forth in the foregoing description, together with details of the structure and function of the present disclosure, the disclosure is illustrative only, and changes may be made in the details, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a plurality of first antenna units; and a plurality of second antenna units, each of the second antenna units is positioned adjacent the first antenna units, each of the first antenna units and each of the second antenna units is restricted to emit a radio beam in a single polarization direction, the first antenna unit emits radio waves in a first polarization direction, the second antenna unit emits radio waves in a second polarization direction; wherein the first polarization direction is perpendicular to the second polarization direction;

wherein each of the first antenna unit comprises a first antenna, each of the first antennas comprises a main body, and a first end of the main body portion defines two notches configured for increasing a bandwidth of the first antenna.

2. The antenna structure of claim 1, wherein each of the second antenna units comprises a second antenna, each of the first antennas is positioned between adjacent two of the second antennas.

3. The antenna structure of claim 2, further comprising a grounding portion configured for grounding the first antenna units and the second antenna units.

4. The antenna structure of claim 3, further comprising a dielectric board, wherein the dielectric board comprises N dielectric layers, the grounding portion comprises N+1 grounding layers, wherein N is a positive integer, the dielectric layers and the grounding layers are alternately stacked.

5. The antenna structure of claim 4, wherein the grounding portion comprises at least one via, the at least one via passes through each of the dielectric layers to connect each of the grounding layers.

6. The antenna structure of claim 5, wherein each of the first antennas further comprises a bending portion, the main body is disposed on a first wall of the dielectric board, the bending portion is bent relative to the main body and disposed on an upper surface of the dielectric board.

7. The antenna structure of claim 6, wherein each of the first antenna units further comprising a first feeding line, the first feeding line is connected to an end of the main body, each of the second antenna units further comprising a second feeding line, the second feeding line is connected to an end of the second antenna, the first feeding line is configured for feeding current to the first antenna thereby activating the first antenna to generate electromagnetic waves in the first polarization direction, the second feeding line is configured for feeding current to the second antenna thereby activating the second antenna to generate electromagnetic waves in the second polarization direction.

8. The antenna structure of claim 5, wherein each of the first antenna units, the second antenna units, the grounding layers and the vias is made of conductive materials.

9. The antenna structure of claim 1, wherein a number of the first antenna units and a number of the second antenna units is the same.

10. A wireless communication device comprising:

an antenna structure comprising:

a plurality of first antenna units; and a plurality of second antenna units, each of the second antenna units is positioned adjacent the first antenna units, each of the first antenna units and each of the second antenna units is restricted to emit a radio beam in a single polarization direction, the first antenna unit emits radio waves in a first polarization direction, the second antenna unit emits radio waves in a second polarization direction; wherein the first polarization direction is perpendicular to the second polarization direction;

wherein each of the first antenna unit comprises a first antenna, each of the first antennas comprises a main body, and a first end of the main body portion defines two notches configured for increasing a bandwidth of the first antenna.

11. The wireless communication device of claim 10, wherein each of the second antenna units comprises a second antenna, each of the first antennas is positioned between adjacent two of the second antennas.

12. The wireless communication device of claim 11, wherein the antenna structure further comprises a grounding portion configured for grounding the first antenna units and the second antenna units.

13. The wireless communication device of claim 12, wherein the antenna structure further comprises a dielectric board, wherein the dielectric board comprises N dielectric layers, the grounding portion comprises N+1 grounding layers, wherein N is a positive integer, the dielectric layers and the grounding layers are alternately stacked.

14. The wireless communication device of claim 13, wherein the grounding portion comprises at least one via, the at least one via passes through each of the dielectric layers to connect each of the grounding layers.

15. The wireless communication device of claim 14, wherein each of the first antennas further comprises a bending portion, the main body is disposed on a first wall of the dielectric board, the bending portion is bent relative to the main body and disposed on an upper surface of the dielectric board.

16. The wireless communication device of claim 15, wherein each of the first antenna units further comprising a first feeding line, the first feeding line is connected to an end of the main body, each of the second antenna units further comprising a second feeding line, the second feeding line is connected to an end of the second antenna, the first feeding line is configured for feeding current to the first antenna thereby activating the first antenna to generate electromagnetic waves in the first polarization direction, the second feeding line is configured for feeding current to the second antenna thereby activating the second antenna to generate electromagnetic waves in the second polarization direction.

17. The wireless communication device of claim 14, wherein each of the first antenna units, the second antenna units, the grounding layers and the vias is made of conductive materials.

18. The wireless communication device of claim 10, wherein a number of the first antenna units and a number of the second antenna units is the same.

* * * * *